US005505871A

United States Patent [19]

Harder et al.

[11] Patent Number: 5,505,871

[45] Date of Patent: Apr. 9, 1996

[54] ELECTRORHEOLOGICAL ELASTOMERIC COMPOSITE MATERIALS

[75] Inventors: C. Ross Harder, Racho Santa Fe; Paul W. Trester, Encinitas, both of Calif.

[73] Assignee: General Atomics, San Diego, Calif.

[21] Appl. No.: 157,664

[22] Filed: Nov. 23, 1993

[51] Int. Cl.[6] ..... C08K 5/54; C08L 83/00; C08J 5/24; C09K 3/00

[52] U.S. Cl. ..... 252/78.3; 252/73; 252/572; 521/82; 524/81; 524/588; 524/858

[58] Field of Search ..... 252/73, 572, 77, 252/78.3; 524/858, 588, 81; 521/82

[56] References Cited

U.S. PATENT DOCUMENTS

| | | | |
|---|---|---|---|
| 4,840,112 | 6/1989 | Bhadra et al. | 91/459 |
| 4,990,279 | 2/1991 | Ahmed | 252/73 |
| 5,000,299 | 3/1991 | Goto et al. | 188/267 |
| 5,032,307 | 7/1991 | Carlson | 252/73 |
| 5,073,282 | 12/1991 | Ahmed | 252/77 |
| 5,094,328 | 3/1992 | Palmer | 192/21.5 |
| 5,194,181 | 3/1993 | Reitz | 252/500 |
| 5,290,821 | 3/1994 | Sakurai et al. | 521/82 |
| 5,352,718 | 10/1994 | Ishino et al. | 524/66 |
| 5,364,565 | 11/1994 | Li | 252/500 |

FOREIGN PATENT DOCUMENTS

| | | |
|---|---|---|
| 5-5099 | 1/1993 | Japan . |
| 6-49477 | 2/1994 | Japan . |
| 1147341 | 3/1985 | U.S.S.R. . |

OTHER PUBLICATIONS

Halsey, T., "Electrorheological Fluids," *Science* 258:761–766 (Oct. 1992).

Halsey and Martin, "Electrorheological Fluids," *Scientific American* pp. 58–64 (Oct. 1993).

*Primary Examiner*—Christine Skane
*Attorney, Agent, or Firm*—Fitch, Even, Tabin & Flannery

[57] ABSTRACT

An electrorheological(ER) composite material with solid, elastomeric characteristics in the form of an elastomer matrix encompassing an ER fluid. This ER composite material changes certain of its physical properties in response to an imposed electric field (as do known ER fluids), but it has the advantage of maintaining a defined spatial volume without the need of sophisticated seals. It also provides desirable design features inherent in an elastic solid having the specific capability of being molded in conjunction with a containment surface to which it strongly adhesively bonds. Certain physical properties of these ER composite materials and their physical response to the application of an electric field may be varied by varying the properties and/or the proportions of the ER fluid component and the resin prepolymer component which are employed in formulating the composite.

17 Claims, 2 Drawing Sheets

ELECTRORHEOLOGICAL ELASTOMERIC COMPOSITE MATERIALS

FIELD OF THE INVENTION

The present invention relates generally to electrorheological fluids and more particularly to structures of defined shape which contain electrorheological fluids.

BACKGROUND

Electrorheological (ER) fluids have been known for a number of years in the form of colloidal dispersions of particles, usually polymeric, in a low conductivity medium, which fluids undergo a dramatic change in physical properties, e.g. viscosity when exposed to an electric field. ER fluids are capable of changes in physical properties within a millisecond and should promptly revert to their initial (zero field) condition upon removal of the electric field.

The ability of ER fluids to respond rapidly to electrical fields should theoretically allow ER fluids to take the place of certain electromechanical components. The application of an electric field increases the viscosity and yield stress of the fluid. In a sufficiently strong field, the ER fluid changes to a semi-solid, which supports shear stress allowing for transfer of energy, e.g. torque. ER fluids therefore should be particularly useful in providing a rapid response interface between electronic controls and mechanical devices, thereby increasing the speed and number of repetitions the device can perform.

ER fluids are proposed for use in electromechanical clutches, as described in U.S. Pat. No. 5,073,282 to Ahmed. U.S. Pat. No. 5,000,299 to Goto et al. describes a shock absorber including a cylinder chamber which is divided into two chambers containing ER fluid, and ER fluids are considered to have substantial applications as shock absorbers. U.S. Pat. No. 5,094,328 to Palmer describes a clutch system employing an electrorheological fluid which transmits torque between two sets of interleaved plates. U.S. Pat. No. 4,840,112 to Bhadra et al. describes an electrically controlled combined valve/cylinder apparatus containing ER fluids. Other promising applications include fluid-filled engine mounts, high speed valves with no moving parts, and interfaces between the electronic and mechanical parts of machines.

Electrorheological (ER) fluids are generally considered to consist of four components: the fluid medium or dispersing vehicle, the particles, a polar liquid or activator, and optional stabilizers which function to keep the particles dispersed in the absence of an electrical field. The fluid medium is a nonpolar, hydrophobic, electrically-insulating liquid having a low dielectric constant and generally a permittivity less than that of the particles, such as mineral oil, silicone oil, and aliphatic hydrocarbons, particularly chlorinated hydrocarbons. The particles are generally hydrophilic substances, such as silica-gel, starch, ionic polymers, e.g. alginic acid, polymethacrylates, phenolformaldehyde resins, and other synthetic polymers. Particle size is important. A size large enough to overcome kinetic forces imposed by the suspending medium is required; however, particles should be small enough to move freely and to have gravitational and buoyancy forces nearly equal. Particles having a size of about 30 μm are typical, and the partial volume fraction occupied by particles in ER fluids is often near 25%. The activator is generally a polar liquid, such as water or an alcohol or other liquid which contains amine or alcohol groups, e.g. ethylene glycol, diethylamine, or the like. Such water may contain dissolved salts. The activator coats the surfaces of the particles allowing the particles to become polarized under an electric field. A stabilizer, such as a surfactant, is optionally added to maintain the particles dispersed in the ER fluid in the absence of an electrical field. Surfactants known in the art include fatty acid esters, fatty amines, glycerol, and glycerol esters.

The controllable behavior of ER fluids is believed to be caused by the induced polarization of the particles when an electric field is applied. The polarized particles then interact to form a filamentary network structure, which results in increased viscosity as illustrated in T. C. Halsey, *Science*, 258, 761–766 (1992).

This mechanism of operation at a molecular level is also described in a survey article entitled "Electrorheological Fluids" by T. C. Halsey and J. E. Martin which appears in the Oct. 1993 issue of *Scientific American*.

A number of problems with the use of ER fluids have prevented their widespread commercial application. One problem affecting the use of ER fluids is the tendency of the particles to clump and/or settle out of the fluid under gravitational force. Such settling of particles disturbs the ability of the particles to form an internal network upon polarization under an electric field. Attempts have been made to correct the tendency to sediment; for example, U.S. Pat. No. 5,032,307 to Carlson discloses the use of anionic surfactant compositions which are designed to act as both the particle component and as a surfactant to maintain a particle dispersion. U.S. Pat. No. 4,990,279 to Ahmed discloses the formation of hydrophilic shells or globules around hydrophobic polymers to maintain dispersion of particles. There remains a need however, for improved means for maintaining particle dispersions in ER fluids.

Another problem involved in the use of ER fluids is the difficulty in confining them, and seals are generally required to prevent leakage. An additional problem encountered in using ER fluids in mechanical devices is that some particles may have an abrasive effect on the surfaces of mechanical parts, requiring the shielding of these surfaces from contact therewith. Still another potential problem with ER fluids is the difficulty encountered in stably locating one or more electrodes in association with such a liquid medium.

Therefore, it is an object of the present invention to provide a material which overcomes the negative limitations of ER fluids as they are presently available. It is a further object of the present invention to provide means for preventing the settling of ER fluid particles, leakage of the ER fluid, abrasion of mechanical surfaces, and for facilitating the stable location of electrodes in association with ER fluids. Still another object is the introduction of the concept of a solid polymer structure of generally cohesive character into the field in contrast to traditional ER fluids used heretofore. Yet another object is to provide a "smart" solid material which can adapt its physical properties as desired in a closely controlled behavior or manner.

SUMMARY OF THE INVENTION

The present invention provides an intrinsically electrorheological elastomeric composite material that can be employed as a solid material and that is composed of an elastomer matrix which encompasses an electrorheological (ER) fluid. This material contains about 5 to 30 volume percent elastomer solid which is of open-cell character and about 95 to 70 percent ER fluid entrained within the elastomer pore space. It exhibits a dramatic change in physical properties when subjected to an electric field. Thus, these composite materials exhibit the handling properties of a solid and the physical or controllable behavior of an ER fluid or liquid. The structure morphology and the physical properties of the structure of these electrorheological composite materials, as well as their responsiveness to an electric field, may be altered as desired by adjustment of the constituent percentages and of the processing parameters in fabricating the material.

DESCRIPTION OF PREFERRED EMBODIMENTS

Figure 1:
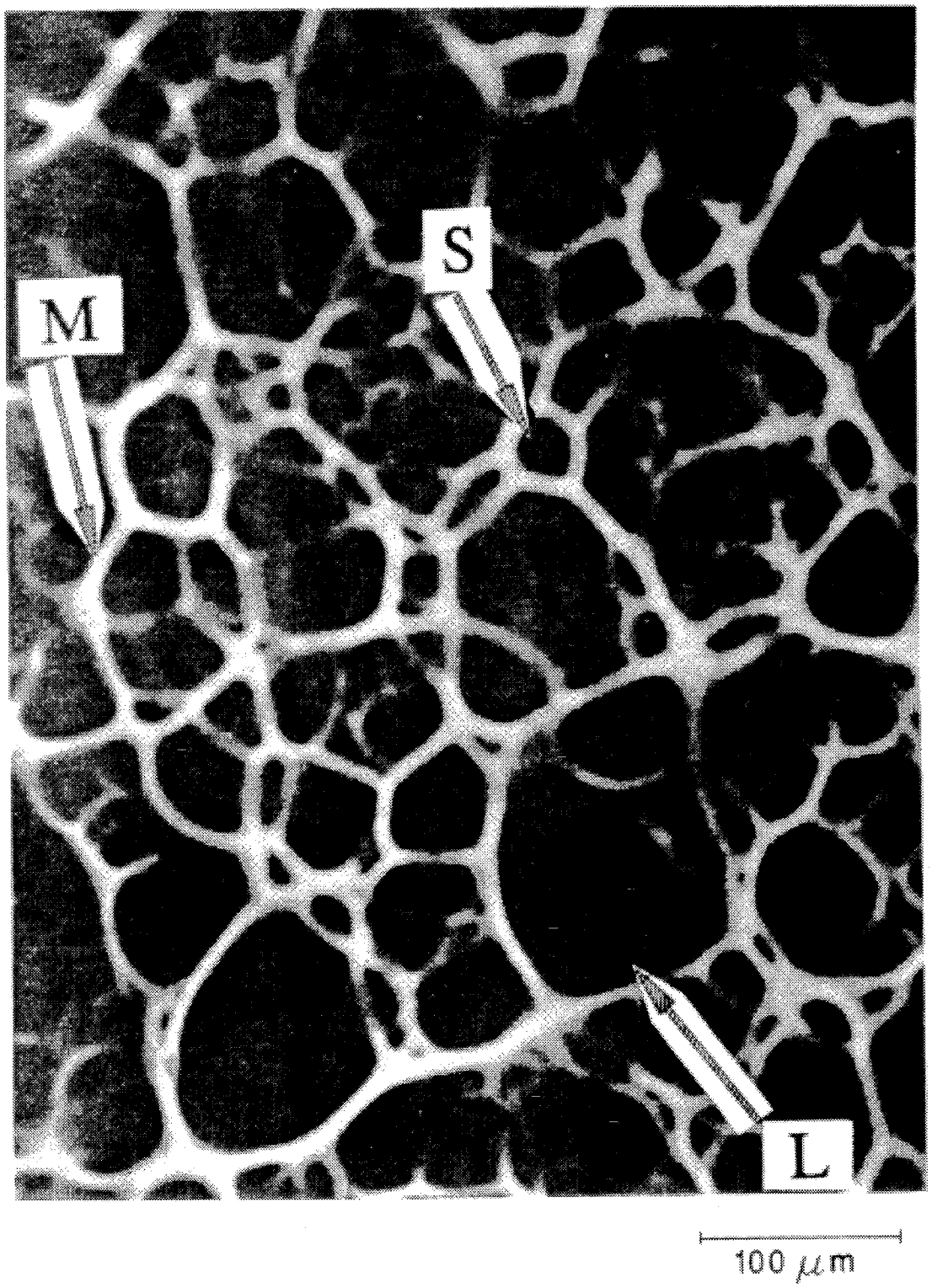
FIG. 1 is an optical photomicrograph of a preferred silicone elastomer/silicone oil/corn starch embodiment of an ER composite material wherein the cell sizes of the elastomer vary from about 30 μm to about 100 μm.

Unless otherwise defined, all technical and scientific terms used herein have the meaning commonly understood by one of skill in the art to which this invention belongs.

As used herein, the term "elastomer" refers to a polymeric material made of long flexible chainlike molecules cross-linked by intermolecular bonds which, during processing, forms an insoluble three-dimensional structure. Prepolymers of such elastomer are sometimes referred to herein as "resins", and the process of formation of the three-dimensional structure, which is often initiated by the addition of a catalyst to the resin, is referred to as "curing" the resin.

As used herein, the term "open-celled elastomer" refers to a three-dimensional structure made of a network of ligaments or fibrils that form pores which are interconnected with one another. Closed cell structures, in contrast, comprise pores which are not generally interconnected or open to one another.

As used herein, the term "ER properties" refers to the ability of a material to a change in "stiffness" or elasticity in response to an applied electric field. ER fluids and the ER composite materials of the present invention have a characteristic response which generally increases as the strength of the applied electric field increases. Certain variations in the composition of the ER composite materials can be employed to alter the magnitude of this characteristic response to increasing electric fields.

The present invention provides a material composed of an elastomer matrix encompassing an electrorheological (ER) fluid. This material, termed an electrorheological elastomeric composite material, contains approximately 5 to 30 volume percent elastomer and between approximately 95 to 70 volume percent ER fluid, and the elastomeric structure is formed to confine the ER fluid without substantial weeping but in a manner that does not adversely affect its ER properties. The application of an electric field of sufficient strength to this material results in a dramatic change in physical properties of the ER composite material. Representative ER composite materials having an initial shear modulus of elasticity (static) of about 6000 to about 11,000 pascals, for moderate shear strains of about 30% or less when not subjected to an electric field, exhibit a shear modulus of elasticity that is increased by 30 to 35% when subjected to a moderate electric field. The change in this shear modulus of elasticity varies with the magnitude of the applied electric field. In the ranges investigated, no maximum value was observed. One way of measuring the shear modulus G is by measuring the shear stress $\tau$ for a series of shear strains, i.e. $G=\Delta\tau/\Delta\gamma$, in a stress region where the behavior with corresponding strain is linear. Shear strain $\gamma$ is equal to the axial relative displacement divided by the radial thickness of the ER elastomer composite.

The change in elastic properties of the ER composite materials of the present invention occurs extremely rapidly. The approximate response time of this material to the application of an electric field is on the order of 0.001 second. The change in elastic properties is also fully reversible within a short time period upon removal of the electric field. The ER composite material responds by changing its elasticity or "stiffness" when an electric field is applied of at least approximately 500 volts per mm (millimeter of thickness); however, electric fields of up to approximately 4000 volts per mm are sometimes applied. Typically, the response of ER composite materials is determined by measuring shear stress or other parameters according to standard engineering methods known in the art. The electric field required to obtain a maximum response in the ER properties of certain of these materials is approximately 4 kV/mm. By locating the electrodes in very close proximity to each other, it can be seen that such voltage requirements will be lower. The present invention allows electrodes in such a system to be routinely spaced apart distances as close as about 0.2 mm because the solid nature of the material acts as a positive deterrent to potential shifting and/or misalignment.

The electrorheological fluid component of the materials of the present invention may be selected from available ER fluids known in the art. These ER fluids contain a particle phase, a liquid medium or dispersing vehicle phase, and an activator; they also optionally contain a surfactant. The preferred proportions of the components which constitute ER fluids used in the ER composite materials of the present invention are generally known in the art and comprise about 15 to about 45 weight percent of particles plus activator, and about 85 to about 55 weight percent liquid, which serves as a carrier for the particles which are suspended therein. The amount of activator contained in these ER fluids is usually about 1.0 weight percent or less.

The preferred ER particles are hydrophilic particles of spheroidal shape which are between approximately 5 to approximately 100 μm in size, and are preferably approximately 15 to about 25 μm in size. Particles of these preferred sizes are generally selected from ER particles known in the art, including hydrophilic particles of silica-gels, starches, ionic polymers, e.g. alginic acid, polymethacrylates, phenolformaldehyde resins, and other synthetic polymers. These particles are well-known in the art and are commonly commercially available. Preferred ER particles for use in the present invention are lithium polymethacrylates and starch, particularly corn starch molecules, the latter of which affords low cost applications.

The ER vehicle component is a nonpolar, insulating liquid with a low dielectric constant, preferably having a permittivity very substantially less than that of the particulate component. ER vehicles may be selected from those known in the art, e.g. mineral oil, silicone oil, including modified silicone oils such as fluorosilicone oils, and aliphatic hydrocarbons, particularly chlorinated hydrocarbons. Fluorinated silicone oils may afford additional stability to the particle suspensions. A preferred ER vehicle for use in the ER composite material of the present invention is silicone oil, and preferred silicone oils have a viscosity of between about 20 centistokes and about 100 centistokes; however, silicone oils having viscosities from about 10 centistokes to about 500 centistokes can be used. Varying the viscosity of the silicone oil results in some variation in the ER properties of the final ER composite material.

The ER fluid used in the present invention also contains an activator component of approximately 1.0 weight percent or less. The activator is selected from known activators and usually is a polar liquid such as water or some other liquid containing an amine or alcohol. A preferred activator is water at a level of about 0.5 weight percent.

A surfactant, such as a fatty acid ester, a fatty amine, glycerol or a glycerol ester may optionally be included to maintain the dispersion of the particulate fraction of ER fluids. However, when corn starch is used together with silicone oil, which is the preferred ER vehicle, a surfactant is generally not required for maintaining particles in an adequately dispersed condition.

The elastomer matrix structure of the ER composite material is an open-cell matrix, and the elastomer component for producing such a structure is selected from suitable elastomers known in the art which are capable of forming an open-cell rather than a closed-cell matrix. Examples of such open-cell-forming elastomers are silicone elastomers and polyurethanes. The elastomer component is preferably formulated to form cells in the size range of about 20 μm to about 200 μm and preferably from about 20 μm to about 80 μm. Suitable elastomer components are typically prepolymers which are combined with a catalyst or a crosslinking agent when ready for use; they are then allowed to set or cure at a prescribed temperature, which may be ambient temperature. An example of polyurethane resin which can be used is one that forms a reticulated, open-cell polyether polyurethane elastomeric foam. Preferred elastomers are polysilicones which are formed from a condensation-cure-type silicone polymer resin using a liquid organo-tin catalyst, in the presence of a diluent of a polydimethylsiloxane liquid, i.e. silicone oil. Preferred silicone elastomers cure at room temperature or slightly higher, for example, between about 25° C. and about 40° C. Temperatures higher than about 40° C. are generally avoided because the liquid catalyst is fairly volatile and could evaporate at higher temperatures and thus detract from the completion of the polymerization reaction. The preferred silicone elastomer resin for use in the ER composite material is a mixture of dimethylsiloxane oligomers or prepolymers which include reactive hydroxyl-terminated moieties and nonreactive moieties. Resins for forming such elastomers are commercially available as a package containing such prepolymers and catalyst, for example, from Custom Resin Systems, Inc., and the resins are available from Dow-Corning. These prepolymer resins are cured by the addition of a suitable liquid catalyst, such as dibutyl-tin-dilaurate, referred to herein as DTD catalyst. As indicated above, a diluent fluid is preferably added to increase softness and decrease stiffness of the elastomers, and the ER fluid serves this function in the polymerization reaction to form the silicone elastomer. The preferred diluent is a silicone oil which is a linear polydimethylsiloxane terminated with non-reactive methyl groups and this liquid also functions very well as the vehicle in the ER fluid.

The ER composite materials are made by mixing a desired ER fluid with the desired elastomer prepolymer and adding a suitable catalyst. Because of its nature, the silicone oil ER fluid acts as a diluent for the silicone resin prepolymer and causes an elastomer to be formed having lower stiffness and increased softness. These ingredients are mixed in proportions to give the desired final volume percentages of solid elastomer and ER fluid, which are usually between about 5 to about 30 volume percent elastomer and about 95 to about 70 percent of ER fluid; however, preferably the matrix occupies between about 5 and about 15 volume percent of the composite material. This is accomplished by mixing appropriate amounts of resin and catalyst with the ER fluid. The ratio of resin to ER fluid can be varied within these ranges to produce specific physical and structural parameters desired. For example, varying the ratio of resin to diluent (i.e. ER fluid) in the reaction mixture can alter the size of the cells in the ultimate elastomer matrix and the thickness of the ligaments or fibrils which define these cells. To obtain smaller cell sizes in the ER composite material, a larger ratio of resin to diluent is used, and such smaller cell sizes may be particularly satisfactory when the ER fluids comprise particles of relatively small size so that their mobilities are not hampered by the small cell sizes. Moreover, a larger fraction of resin also produces generally thinner ligaments or fibrils in the ultimate elastomeric structure. On the other hand, varying the composition and/or properties of the ER fluid can change the ER properties of the ER composite material.

As the presence of the catalyst causes the mixture of resin prepolymers and ER fluid-diluent to cure, the elastomer forms as an open-cell structure encompassing the ER fluid. These cells of the ultimate elastomer structure adequately confine the ER fluid in a manner so that no substantial weeping occurs. The plurality of open cells of the elastomer structure serve to widely distribute the particle-bearing liquid of the ER fluid, which prevents settling out of the particles. The open-celled arrangement of the elastomer allows free movement of the individual particles of the ER fluid within the cells and between cells, and it allows the formation of an internal polarized particle network when the material is placed under an electric field.

The resin and ER fluid diluent are preferably thoroughly mixed together to disperse one within the other before the curing or final polymerization reaction is begun. Then a suitable liquid catalyst, typically equal to at least about 10 weight percent of the silicone resin prepolymers, is added; greater amounts of catalyst can be used without adversely affecting the reaction. This mixture is allowed to cure at a suitable temperature, which is typically between about 20° C. and 40° C. Temperatures near 35° C. can shorten the curing time to about 1 hour compared to curing for about 4 hours at room temperature. There may be advantages to carrying out the curing while an electric field is applied, e.g. about 2 kV/mm. However, substantially higher temperatures are usually avoided because of the volatility of such liquid catalysts. The ER fluid/resin/catalyst mixture is preferably placed in a mold of suitable shape to conform with its desired ultimate application so that curing of the resin prepolymer produces a structure of defined three-dimensional shape wherein the ER fluid is confined. It may be preferred to continue to stir or agitate the liquid mixture until the increase in viscosity indicates that it is nearing cure-onset, i.e. is about to begin to set, and then add the mixture to the mold. Because uncured silicone elastomer tends to bond adhesively to most materials (including cured silicone elastomer) during the curing phase, advantageous designs based upon this property are enabled. On the other hand, a thin film of a release agent, such as petroleum jelly or fluorocarbon grease, may be used to preclude adhesion, if desired.

The structure of ER composite materials may be easily visualized by sectioning such materials and viewing them under a reflective light optical microscope at about 200× magnification. ER composite materials including silicone elastomers, for example, typically contain a fairly constant distribution of cells which may be classified as small, medium, and large. A preferred range of size of cells is from about 20 to about 100 μm in size, and preferably the ratio of resin and ER fluid is adjusted so that a major portion of the open cells, e.g. at least about 60% of them volumetrically, fall within this size range. One embodiment of an ER composite material, wherein a silicone elastomer is filled with a silicone oil/corn starch ER fluid, is shown in FIG. 1, which is a photomicrograph of about 200× magnification. Three representative cells of different sizes are marked with the letter "S" for a small-sized cell, "M" for a medium-sized cell, and "L" for a large-sized cell. The light-colored material constitutes the fibril or ligament connecting structures which form the open cells.

In another acceptable ER composite material, an ER fluid in the form of particles of lithium polymethacrylate dispersed in silicone oil is confined in an open-celled polysilicone elastomer having a pore size between about 20 and 80 μm. This ER composite material produces a fairly wide range of ER responses when different electric fields are applied.

A presently preferred embodiment of ER composite material utilizes a polysilicone elastomer containing an ER fluid of silicone oil and corn starch particles, preferably using water as an activator. Preferably, the corn starch particle sizes are approximately 15 to 25 μm, and the ER fluid contains about 20 to about 40 weight percent of particles, based upon total weight of such particles plus vehicle, and most preferably between about 28 and about 33 weight percent particles.

The process of making a preferred ER composite material is described in Example 1 hereinafter. The proportion of starting ingredients for an ER composite material may be varied to alter the properties and the microstructure of the final ER composite material. This is demonstrated for the presently preferred corn starch-silicone oil-silicone elastomer embodiment in the experiments described in Examples 2 and 3 below. Example 2 describes the overall decrease in the size of cells of this ER composite material as the percent of resin in the resin/diluent mixture is increased and also the decrease in the thickness or diameter of the cell fibrils of this ER composite material as the percent of resin in the mixture is increased. Example 3 describes the variation in ER response of such materials when the viscosity of the silicone oil is varied.

The following examples are intended to illustrate but not limit the invention.

EXAMPLE 1

An intrinsically ER composite material is prepared so as to contain a silicone oil/corn starch ER fluid encompassed by a silicone elastomer structure. First, an appropriate quantity of corn starch particles is weighed out, spread over a sheet and moistened by misting lightly with water. The water serves as the activator to promote ionic transfer for polarization within the ER fluid. Then a slurry is prepared by adding a pre-weighed amount of a linear polydimethylsiloxane silicone oil to the particles, and then manually or automatically stirring the mixture to create a dispersion. The silicone oil serves as both a vehicle in the ultimate ER composite structure and as a diluent during the polymerization reaction. About 28 weight percent of starch particles based upon total weight of starch plus silicone oil is used for the slurry. The silicone oil is Dow-Corning Silicone 200® Fluid, of a particular viscosity level within the range of 20 to 100 centistokes, which is also commercially available from the A. E. Yale Co. Following preparation of this slurry, which will constitute the ER fluid in the final product, polydimethyl-siloxane resin prepolymers are admixed to create a mixture that contains about 1 part by weight resin prepolymers to 9 parts by weight of the silicone oil. These silicone resin prepolymers are obtained from Custom Resin Systems, Inc. under the designation CRS-1214A. This ER fluid/resin prepolymer mixture is manually stirred for about two minutes to disperse the resin prepolymers throughout the ER fluid and create a uniform liquid mixture. A liquid catalyst, dibutyl-tin-dilaurate (CRS-1214B), is then added in an amount equal to about 10 weight percent of the total amount of diluent and resin used in the mixture. After stirring for at least about 2 minutes to thoroughly disperse the catalyst, the mixture is added to a mold where curing takes place. Curing is carried out at room temperature for approximately 4 hours. FIG. 1 is representative of the open-celled structure of the resultant silicone elastomer ER product. Testing shows this ER composite material has good ER properties when exposed to an electrical field.

The ER composite material may be formed in association with an electrode or with coating and/or stiffening materials, such as polyethylene or other films or large cell polyurethane reticulated foam. For example, an electrode may be inserted within the mold containing the resin/diluent mix or a flat electrode may be used as on the surface of the mold to which the open-celled resin structure will adhere. Adherence can be enhanced by first precoating the clean surface of the electrode or other adherent film material with a primer; one suitable precoating material is a liquid sold as Sylgard® Prime Coat manufactured by Dow-Corning Corporation. Alternatively a tough skin may be bonded onto a surface of the ER composite material after this material has solidified and been removed from the mold, using a silicone adhesive or the like. As an example, a film could be used to line a mold and thus create a surface coating layer in situ, or a more dense, firm layer could be subsequently cured in place on a surface of the ER composite material by applying a thin layer of a mixture of, for example, about 45 weight percent resin, about 45 weight percent silicone oil and about 10 weight percent catalyst to the desired surface. A large cell polyurethane reticulated foam, e.g. having open cells of about a millimeter in size, can be incorporated into a molded ER composite structure by lining the bottom of a mold with such material; it might be used, for example, for the purpose of providing a stronger, reinforcing, transition region to facilitate secure attachment of the ER composite material to a metal surface.

Figure 2:
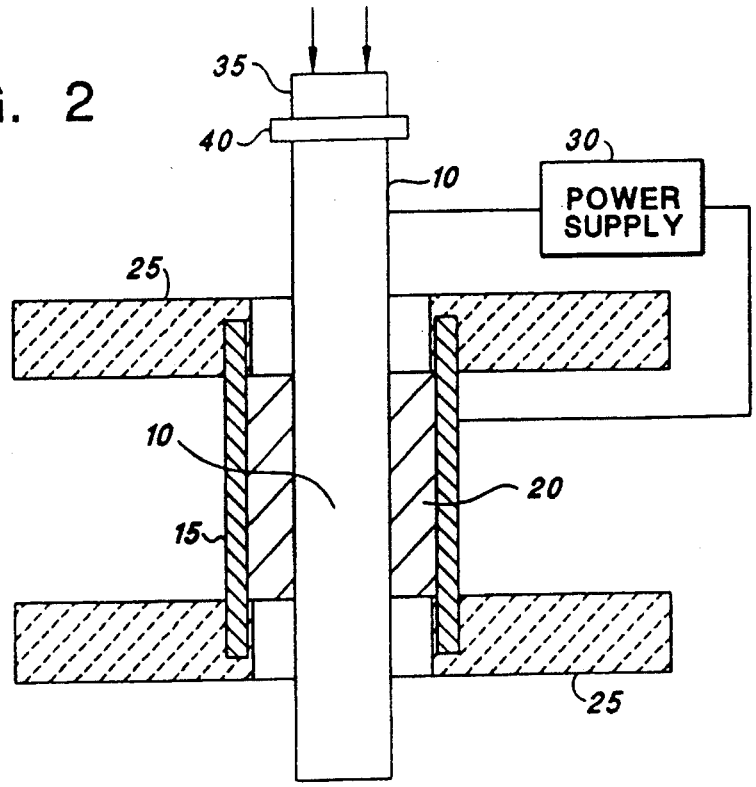
FIG. 2 shows an apparatus used to measure shear stress of an ER elastomeric composite under the presence of an applied electric field established by applying a potential difference between two cylindrical electrodes. A load cell measures the force required to move an inner cylinder in an axial direction relative to an outer hollow cylinder and at a specified rate of translation, with the ER composite material occupying the annulus therebetween and being bonded thereto. The shear stress for a given translation or shear strain is calculated as the applied mechanical force divided by the area on the inner cylinder to which the ER composite material is adhered. The applied electric field is varied as desired by changing the applied voltage across the annular region.

An ER composite material may be tested to determine its modulus of elasticity under various electric fields using an axial shear stress test apparatus such as that pictured schematically in FIG. 2; in this design configuration, static shear modulus of elasticity is obtained. In this apparatus, the reference numeral 10 designates an inner cylinder, 15 designates an outer hollow cylinder, and 20 designates the ER composite material which was formed in place with the two cylinders 10, 15 serving as a mold cavity, along with a removable bottom plug (not shown). Insulating material 25 supports and rigidly fixes the outer hollow cylinder which is spaced apart from the inner cylinder 10 by the ER composite material so that a voltage can be applied across these two electrically conducting elements to establish the electric field to activate the ER material using a suitable variable power supply 30. The illustrated test device applies axial motion at a specified and controlled, constant rate of travel and measures the corresponding resistive shear force from the composite elastomer, bonded to the cylinders. Motion is applied axially to the inner cylinder 10 by a suitable controlled rate driver 35 acting through a load cell 40 which measures and gives an accurate indication of the force being applied. The shear stress is determined by measuring the axial force required to vertically displace the inner cylinder 10 a predetermined distance with respect to outer cylinder 15 and dividing this force by the area of bonding between the ER elastomer and the interior surface of the hollow cylinder 10. This test sequence is repeated with different electric fields being applied across the ER material. For each electrical field, the measured shear stresses are then converted into their static shear modulus of elasticity. These values allow the calculation of the change in modulus, for an increment of displacement, of the ER composite material which results from the application of a range of electric fields.

EXAMPLE 2

The following experiment is performed to determine the variation in size range of elastomer cell sizes as the resin/diluent ratio of the components used in formulating an ER composite material is varied. ER composite materials are made according to a method generally as described in Example 1. The particular ER composite material used in this experiment is formed using ER fluid having a 50 centistoke viscosity silicone oil mixed with about 28 weight percent starch particles. Three different combinations of resin and diluent (i.e. ER fluid) are used: 5, 10 and 20 weight percent resin with 95, 90 and 80 weight percent, respectively, of the silicone oil. To each such mixture, liquid DTD catalyst is then added in an amount equal to about 10 weight percent of the total amount of diluent and resin used in the mixture. After each sample of ER composite is cured at room temperature, it is sliced, and the sliced face is placed under a reflecting light optical microscope at a magnification of approximately 200×. The sizes of the small, medium, and large-sized cells are determined, and averaged for each of the three samples. It is found that the average size of the cells decreases as the percentage of resin increases. When the ER composite material is made using about 5 weight percent of resin prepolymers, the elastomeric structure occupies about 15 volume percent of the ultimate structure, and the average size of the large cells is about 225 μm, the average size of the medium cells about 130 μm, and the average size of the small cells about 75 μm. At about 10 weight percent resin and 90 percent diluent, there is a slight reduction in average sizes to about 220 μm, about 120 μm, and about 65 μm, respectively. When the amount of resin is increased to 20 weight percent, the cell sizes change more dramatically, with the average size of the large cells measuring about 130 μm, the medium cells about 80 μm, and the small cells about 35 μm.

The relative percentages of cells falling into the three categories, i.e. large, medium, and small cells, is also determined for these test samples, and it is found that the percentage of cells in each category varies slightly as the percentage of resin is changed. At 5 weight percent resin, the relative percentages are about 60 percent large cells, 35 percent medium cells, and about 5 percent small cells. When about 10 weight percent resin is used, the percentage of large cells drops to about 55 percent, the percentage of medium cells to about 33 percent, and the percentage of small cells rises to about 12 percent. When the amount of resin is further increased to about 20 weight percent, the percentage of large cells stays about the same, but the percentage of medium cells drops about another point or two with the percentage of small cells rising about the same amount.

These ER composite materials are further examined with respect to changes in the cell fibril or ligament diameters or thicknesses as the percentage of resin is increased. It is determined that the average thickness decreases as the percent of resin is increased from 5 to 20 weight percent (w/o). The average ligament thickness decreases as the percentage of resin, which is used in formulating the resin plus diluent mixture of the ER composite material, is increased, i.e. from about 17 μm at 5 w/o resin, to about 11 μm at 10 w/o resin, and to about 8 μm at about 20 weight percent resin.

EXAMPLE 3

The following experiments were performed to determine the differences in mechanical responses to applied electric fields of increasing strengths of particular ER composite materials made using liquids of different viscosities for the ER fluid component. These materials for these tests were made generally according to the process described in Example 1, i.e. using about 10 weight percent resin to 90 w/o oil diluent, except for one sample employing 20 centistoke silicone oil, wherein 13 w/o resin was used. Ten percent catalyst, based on the total weight of the resin plus silicone oil diluent, was added to each mixture of resin and ER fluid. The viscosity of the silicone oil of the ER fluid varied between 20 centistokes, 50 centistokes and 100 centistokes. The ER fluids contained either about 28 or about 33 weight percent of starch particles. Generally, the lower the viscosity of the oil, the softer is the ER composite material after curing; however, the volume percent of the elastomeric matrix and the weight % of particles in the ER fluid also influence this value. After curing, each ER composite material is tested at room temperature at an axial displacement rate of about 0.0085 mm/sec in the shear test assembly described in Example 1. The results are shown in FIG. 3 for a vertical displacement of 0.127 mm (7.3% shear strain), from which it may be seen that the ER composite material containing the least viscous oil, i.e. the 20 centistoke oil, changes most rapidly in its response to applied electric fields.

For comparison purposes, a further test example is made from a mixture of 10 weight percent resin and 90 weight percent 100 centistoke silicone oil (i.e. diluent) containing no ER particles. Again, 10 weight percent catalyst is added to this mixture based upon total weight of resin plus silicone oil diluent, so as to be directly comparable to the other samples. The line of open rectangles at the bottom of the graph shows that, as expected, the application of an electric field across an elastomeric material which is filled with silicone oil diluent that contains no ER particles causes no change in the shear stress to reach the specified forced axial displacements of the inner cylinder relative to the fixed location of the outer tube or hollow cylinder.

Figure 3:
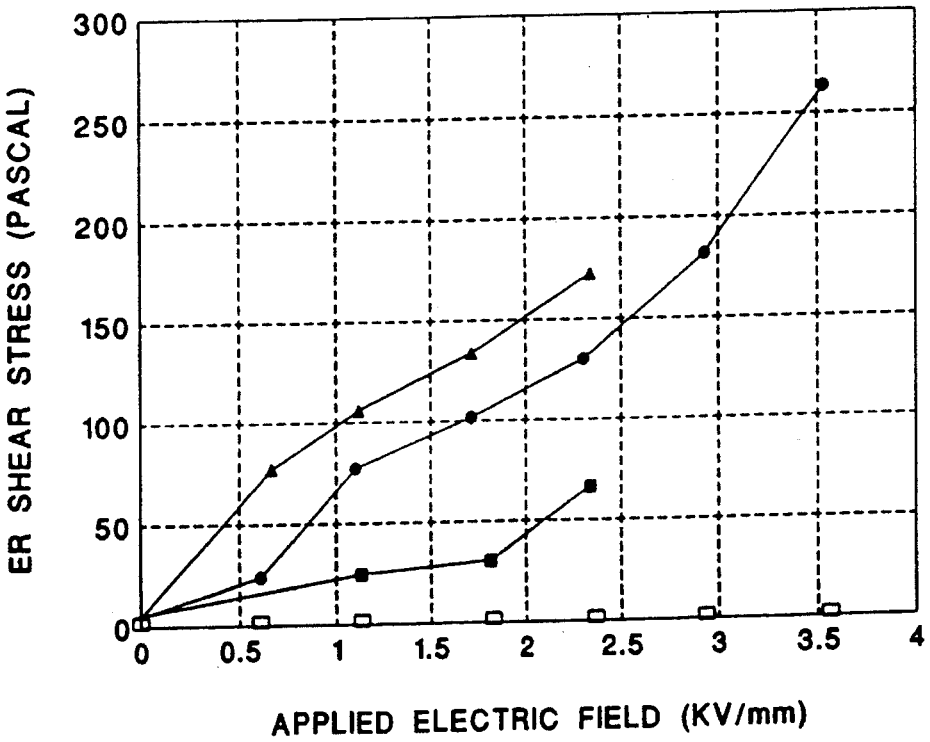
FIG. 3 is a graph showing the influence of the applied electric fields of increasing voltage on the shear stress of an ER elastomeric composite for an axial shear translation to 0.127 mm (7.3% shear strain). Three different ER composite materials made with the same silicone elastomer are tested, and the ER shear stress increment is calculated as the difference between shear stress with the electric field employed and shear stress at zero field. Triangles represent an ER composite material containing 20 centistoke viscosity silicone oil. Filled squares represent an ER composite material containing 50 centistoke viscosity silicone oil. Filled circles represent 100 centistoke viscosity silicone oil, and open rectangles represent the same silicone elastomer containing 100 centistoke silicone oil without any ER particles. About 28 weight % particles were contained in the ER fluid of the 50 centistoke viscosity oil, whereas the other two ER fluids contained 33 wt. % particles.

It can also be seen from FIG. 3 that the changes in the shear stress (and corresponding modulus of elasticity) in each sample increases at about the same proportion with increases in the strength of the applied electrical field once past the test value of about 600 volts per mm.

These essentially solid intrinsically ER composite materials provide a number of advantages over ER fluids which have been used to date. The solid elastomer three-dimensional framework acts as an electrical insulator and advantageously confines the ER fluid within a defined spatial volume. In addition, the essentially solid material provides a structure with which to associate electrodes, as well as a structure that may be employed to structurally support thin flexible electrodes. Although the solid ER composite materials permit the ER fluids to only be expressed or weep therefrom with difficulty, by coating one or more of the surfaces of such an ER composite material, substantially all expression or weeping of the ER fluid from the cells of the material can be prevented, thus assuring that the ER fluid will be confined over long periods of use. Because of the effective containment of the ER fluid within the open-celled polymeric material, the need for sophisticated seals is avoided in many applications. These ER composite materials also have the advantage of being able to withstand a considerable amount of motion by elastic strain due to their low modulus of elasticity and to undergo substantial displacement by elastic, recoverable strain while retaining their ER properties and structural integrity.

In another aspect, an arrangement is advantageously provided wherein the ER composite material is physically attached to at least one electrode and connected to means for applying an electric field across the material. An electrode can be attached, for example, by solidifying (curing) the prepolymer silicone resin, catalyst and ER fluid mixture in situ along one surface of the electrode. Alternatively, a polyurethane open-celled elastomer may be used to take advantage of the inherent strength and adhesive properties of polyurethanes. It may also be possible to employ an electrically conductive elastomer in such an arrangement. Alternatively, an electrode may be subsequently attached using an adhesive, such as a silicone or polyurethane adhesive compatible with the ER composite material.

As previously indicated, a substantially liquid-impermeable skin or film can be provided upon the ER composite material and may be applied to an opposite surface from that associated with an electrode. Separate films, e.g. of polyethylene, of about 25 μm or 12 μm in thickness, are effectively used, or a dense adherent skin can be provided in situ by coating with a mixture of a relatively high percentage of resin, plus an appropriate catalyst, in a compatible silicone oil or other vehicle.

There are a number of applications for which these ER composite materials are expected to have use, and one of these utilizes such ER composite materials to provide a relatively high resolution tactile display containing virtually no moving parts. Other applications of very particular interest use these materials to damp or to control various types of vibrations generated internally or externally; for example, an applied electric field is adjusted as necessary to produce a material of appropriate stiffness in order to damp out or control vibrations. One particular case where resonance frequency could be approached and thereby potentially cause destruction is encountered in the lengthy blades of a helicopter rotor wherein the pitch of the blades is frequently being changed. By appropriately monitoring the frequency of vibrations of such blades, it can be determined when close approach to a potentially destructive resonance frequency is imminent. Then, if the otherwise hollow internal region of each blade contains an integrally attached structure formed of this ER composite material, its stiffness can be quickly altered to prevent the resonance frequency from being reached. Similar applications are anticipated with respect to extended beams to be used for the construction of space stations. The term transmission means is used to broadly define the foregoing applications where the ER composite material is used to transfer forces, vibrations and the like from one mechanical element to another, and the appropriate incorporation of the ER composite material into such structures allows the elastic and/or viscoelastic properties of such transmission means to be varied by applying an electric field of desired magnitude thereacross.

In general, the ER composite materials which are provided, when exposed to an electrical field of appropriate intensity, exhibit the capacity of thereafter maintaining the status quo, so to speak. In other words, whether such a material is stressed or unstressed at the time the increased electrical field is applied, it exhibits a tendency to maintain that particular configuration and to resist future change.

Although the compositions of the present invention have been described with reference to certain presently-preferred embodiments, it should be understood that various changes and modifications can be made without departing from the scope of the invention which is defined by the following claims. Particular features of the invention are emphasized in the claims that follow.

What is claimed is:

1. An intrinsically electrorheological elastomeric composite material comprising an open-cell polysilicone elastomer matrix containing a major proportion of cells of between about 20 μm to about 200 μm in size and encompassing and confining an electrorheological (ER) fluid, said matrix constituting about 5 to about 30 percent of the volume of the composite material, whereby said composite material exhibits the physical properties of a solid and the controllable behavior of an ER fluid.

2. The material of claim 1 wherein said material has a shear modulus of elasticity of between about 6000 pascals and about 11,000 pascals for shear strains of about 30% or less when not subjected to an electric field.

3. The material of claim 2 wherein the volume percentage occupied by said elastomer matrix is approximately 5 to 15 percent of the composite material.

4. The material of claim 1 wherein said elastomer matrix contains a major proportion of cells of between about 20 μm to about 80 μm in size and said ER fluid contains hydrophilic particles and a polar liquid activator at a level of at least about 0.5 weight percent thereof.

5. The material of claim 1 wherein said electrorheological fluid includes hydrophilic particles of about 5 to about 100 μm in size.

6. The material of claim 5 wherein the major portion of said particles are from about 5 to about 25 μm in size.

7. The material of claim 1 wherein said electrorheological fluid includes a minor portion of hydrophilic particles, a major portion of silicone oil as a carrier for said hydrophilic particles, and water as an activator.

8. The material of claim 1 wherein the electrorheological fluid comprises corn starch or polymethylacrylate particles in silicone oil.

9. An intrinsically electrorheological elastomeric composite material comprising an open-cell silicone elastomer matrix containing a major proportion of cells of between about 20 μm to about 200 μm in size and encompassing and confining an electrorheological (ER) fluid, said composite material having a modulus of elasticity of between about 6,000 pascals and about 11,000 pascals for shear strains of about 30% or less when not subjected to an electric field; and said electrorheological fluid including a minor portion of hydrophilic particles from about 5 to about 100 μm in size dispersed in a major portion of silicone oil.

10. The material of claim 9 wherein said elastomer matrix contains cells the major portion of which are between about 20 and about 80 μm in size.

11. The material of claim 10 wherein said electrorheological fluid includes corn starch particles dispersed in silicone oil having a viscosity of between about 20 centistokes and about 100 centistokes.

12. The material of claim 10 wherein said elastomer matrix constitutes between about 5 percent and about 15 percent of the volume of said elastomeric composite material.

13. An arrangement for varying the elastic and viscoelastic properties of transmission means in connection with a mechanical element, which arrangement comprises transmission means in the form of said electrorheological composite material of claim 9 having at least one electrode associated with said elastomer matrix thereof, and having means for applying different electric fields across said electrorheological composite material which electrical field-applying means utilizes said electrode.

14. The arrangement of claim 13 further comprising a substantially liquid-impermeable coating bonded to an exterior surface of said electrorheological composite material.

15. An intrinsically electrorheological elastomeric composite material comprising (a) an open-cell polysilicone elastomer matrix containing a major proportion of cells of between about 20 μm to about 200 μm in size and encompassing and confining an electrorheological (ER) fluid, wherein said composite material exhibits a shear modulus of elasticity of about 6000 to about 11,000 pascals that can be measurably increased when subjected to an electric field, whereby said composite material exhibits the physical properties of a solid and the controllable behavior of an ER fluid, and (b) an electrode adhering to at least one surface of said open-cell elastomer matrix.

16. The material of claim 15 wherein said electrorheological fluid constitutes about 70 to about 95 volume percent of the composite material and includes a major fraction of silicone oil, a minor fraction of hydrophilic particles, the major portion of which are from about 5 to about 25 μm in size, and water in an amount of about 0.5 weight percent thereof as an activator.

17. The material of claim 15 wherein said matrix occupies about 5 to 30 percent by volume of the composite material, and wherein said elastomeric composite material exhibits a shear modulus of elasticity that can be increased by about 30% when subjected to a moderate electric field.

* * * * *